US006249296B1

(12) United States Patent
Nemura

(10) Patent No.: US 6,249,296 B1
(45) **Date of Patent: *Jun. 19, 2001**

(54) EXPOSURE APPARATUS AND IMAGE FORMING APPARATUS USING THE SAME

(75) Inventor: Masaharu Nemura, Numazu (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/428,491

(22) Filed: Oct. 28, 1999

(30) Foreign Application Priority Data

Nov. 4, 1998 (JP) ..... 10-313423

(51) Int. Cl.[7] ..... G03G 15/04
(52) U.S. Cl. ..... 347/138; 347/238
(58) Field of Search ..... 347/130, 138, 347/134, 238, 245, 257

(56) References Cited

U.S. PATENT DOCUMENTS 5,036,339 * 7/1991 Hediger ..... 347/238 X
5,504,516 * 4/1996 Bax ..... 347/238
5,506,612 * 4/1996 Ogata et al. ..... 347/138

* cited by examiner

*Primary Examiner*—Joan Pendergrass
(74) *Attorney, Agent, or Firm*—Fitzpatrick, Cella, Harper & Scinto

(57) ABSTRACT

An exposure apparatus includes a light-emitting device having a linear array of a plurality of light-emitting elements, a driver for driving the light-emitting elements, an image forming optical system for causing light emitted by the light-emitting elements to form an image at a predetermined position. A first support is provided for supporting the light-emitting devicde and the driver. A second support is provided for supporting the image forming optical system. A heat conductive member is provided to interpose in a gap between the first and second supports.

20 Claims, 3 Drawing Sheets

EXPOSURE APPARATUS AND IMAGE FORMING APPARATUS USING THE SAME

BACKGROUND OF THE INVENTION

1. Field of the Invention

The present invention relates to the arrangement of an exposure apparatus used in an electrophotographic image forming apparatus in which a latent image formed by exposing a photosensitive member is developed and transferred to a recording sheet, thereby recording the image.

2. Related Background Art

An image forming apparatus is widely used in practice, in which light emitted by a stationary light source such as an LED array is focused onto the surface of a photosensitive member by using a focusing optical fiber lens array to form a latent image on the surface of the photosensitive drum, and the latent image is visualized with a toner and then transferred onto a recording sheet, thus forming an image. When an LED array is used as an exposure light source, the apparatus can be downsized more than in a case using a laser as the light source.

Particularly, a color image forming apparatus, which has three or four LED arrays and forms a color image by overlaying images corresponding to respective colors obtained by color separation, can utilize the advantage of downsizing obtained by using the LED arrays.

When, however, a color image is formed by overlaying three or four colors, if an overlay error occurs, color misregistration or color irregularity is produced to greatly degrade the image quality. More specifically, in the conventional exposure apparatus, even if the LED arrays are fabricated straight in the initial state, as the apparatus is operated and the temperature in the apparatus increases, the straightness gradually degrades. This is due to the following reason. As the temperature in the apparatus increases, the temperature of an LED head having the LED arrays also increases, and the LED head is distorted due to a difference in thermal expansion of the various types of members.

In order to solve this problem, a fan is provided to cool the LED head, so that the distortion of the LED head is suppressed. In this case, the size of the apparatus, power consumption, and noise disadvantageously increase.

Furthermore, in the conventional LED head, a foreign substance such as the toner or dust may enter through the gap between the constituent elements to attach to the light-emitting portion or image forming means. In this case, light is partly shielded to cause a defect in the image.

SUMMARY OF THE INVENTION

It is, therefore, an object of the present invention has to provide an exposure apparatus which can always maintain appropriate exposure even if heat is generated by the operation of the apparatus.

It is another object of the present invention to provide an exposure apparatus in which a foreign substance can be prevented from attaching to a light-emitting portion or image forming means, so an exposure defect will not occur.

To achieve the above objects, according to the present invention, there is provided an exposure apparatus comprising light-emitting means having a linear array of a plurality of light-emitting elements, a driver for driving the light-emitting elements, and image forming means for causing light emitted by the light-emitting elements to form an image at a predetermined position, wherein the light-emitting means and the driver are supported by a first support, the image forming means is supported by a second support, and a heat conductive member is interposed in a gap between the first and second supports.

To achieve the above objects, according to the present invention, there is also provided an exposure apparatus comprising light-emitting means having a linear array of a plurality of light-emitting elements, a driver for driving the light-emitting elements, and image forming means for causing light emitted by the light-emitting elements to form an image at a predetermined position, wherein the light-emitting means is supported by a first support, the driver and the image forming means are supported by a second support, and a heat conductive member is interposed in a gap between the first and second supports.

According to the present invention, the first and second supports are made of the same material.

According to the present invention, the heat conductive member is made of a resilient body.

According to the present invention, the image forming means is a focusing optical fiber lens array.

According to the present invention, the exposure apparatus is used in an electrophotographic image forming apparatus.

DETAILED DESCRIPTION OF THE PREFERRED EMBODIMENTS

The preferred embodiments of the present invention will be described in detail with reference to the accompanying drawings.

Figure 1:
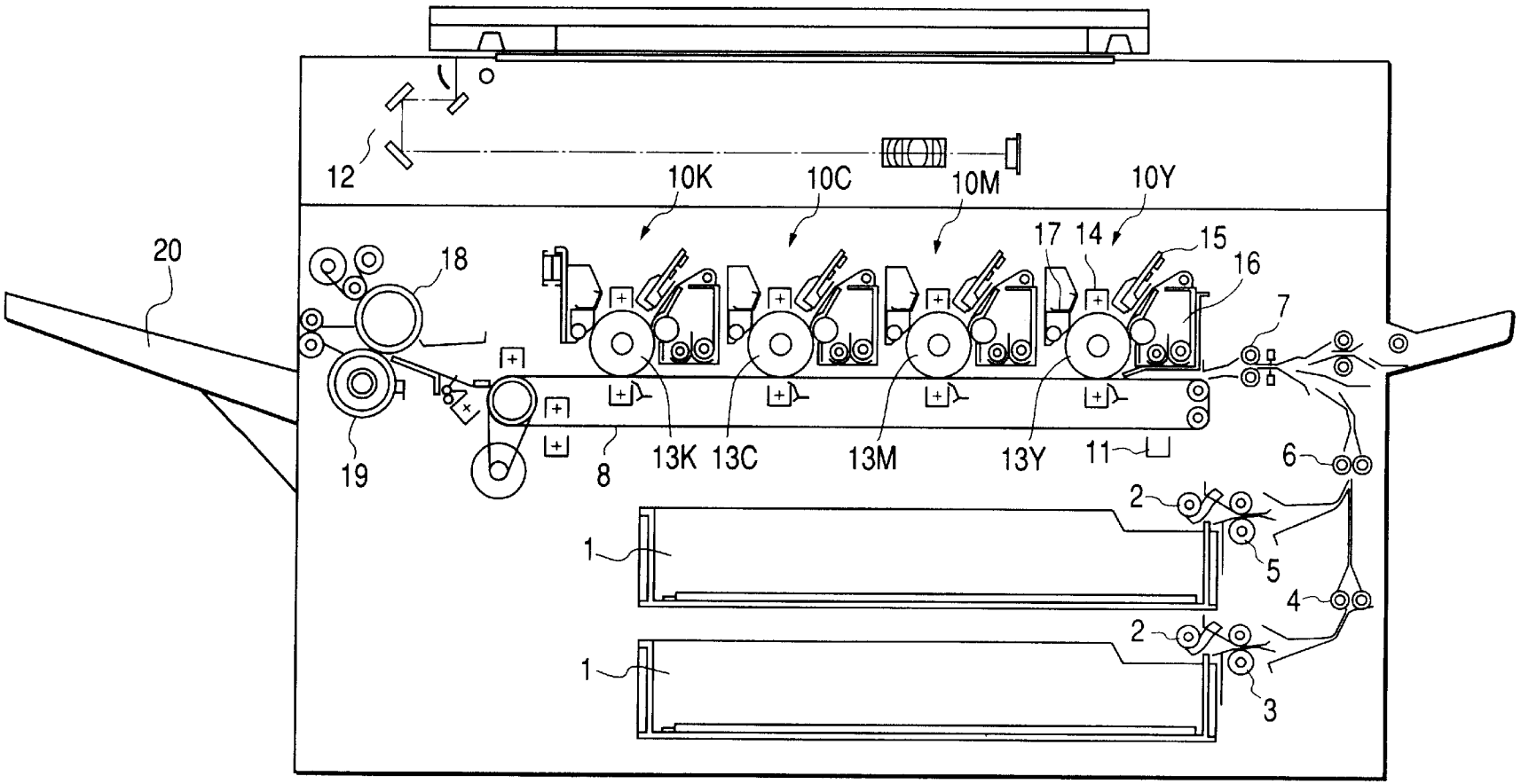
FIG. 1 is a schematic sectional view of an image forming apparatus using an exposure apparatus according to the present invention.

FIG. 1 shows an example of a color recording apparatus using an exposure apparatus of the present invention. This color recording apparatus is a color electrophotographic apparatus which forms a color image by overlaying four different color images, i.e., yellow, magenta, cyan, and black images.

Image forming portions 10Y, 10M, 10C, and 10K respectively form yellow, magenta, cyan, and black images. A transfer belt 8 is provided.

Recording sheets stored in cassettes 1 are fed by feed rollers 2, and are conveyed by convey rollers 3 to 6 to reach registration rollers 7. A ramp state or the like of each recording sheet is corrected by the registration rollers 7, and the recording sheet is fed toward the transfer belt 8 at an appropriate timing. The transfer belt 8 is formed of a sheet made of an insulating resin. The surface of the sheet of the transfer belt 8 is charged by a charger 11 located below it. During charging, latent images corresponding to the respective colors are formed on photosensitive drums 13C, 13M, 13Y, and 13K by image information signals read by an original reader 12 or respective color image information signals sent from an output unit (not shown) such as a computer. The photosensitive drums 13C, 13M, 13Y, and 13K are arranged parallel to each other. The recording sheet fed by the registration rollers 7 is electrostatically attracted by the charged transfer belt 8, and is conveyed to pass below the respective color image forming portions 10Y, 10M, 10C, and 10K.

In the yellow image forming portion 10Y, a charger 14, an exposure LED head 15, a developing unit 16, and a cleaner 17 are arranged around the photosensitive drum 13Y, and a yellow toner image is formed on the surface of the photosensitive drum 13Y by electrophotographic process. In the image forming portions 10M, 10C, and 10K of other colors, magenta, cyan, and black toner images are respectively formed in the same manner on the surfaces of the photosensitive drums 13M, 13C, and 13K by the electrophotographic process.

The toner images of the respective photosensitive drums are sequentially transferred to the recording sheet, being electrostatically attracted and conveyed by the transfer belt, at positions where the transfer belt 8 is close to the photosensitive drums 13C, 13M, 13Y, and 13K. After the four color images are transferred, the recording sheet is separated from the transfer belt 8 by curvature separation and reaches a pair of fixing rollers 18 and 19. The fixing roller 18 is heated by a heater (not shown), and the toners of the respective colors are thermally fused to be fixed to the recording sheet, thereby completing a color image.

After the toner images are fixed to the surface of the recording sheet by the pair of fixing rollers 18 and 19, the recording sheet is discharged onto a sheet discharge tray 20.

Figure 2:
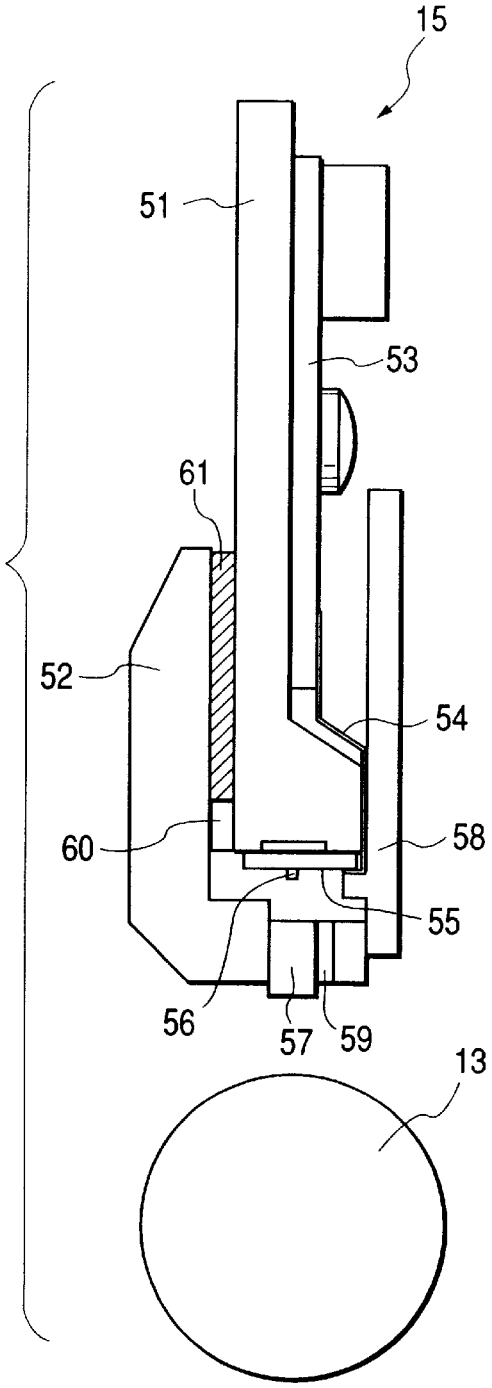
FIG. 2 is a sectional view of the exposure apparatus according to the present invention.
Figure 3:
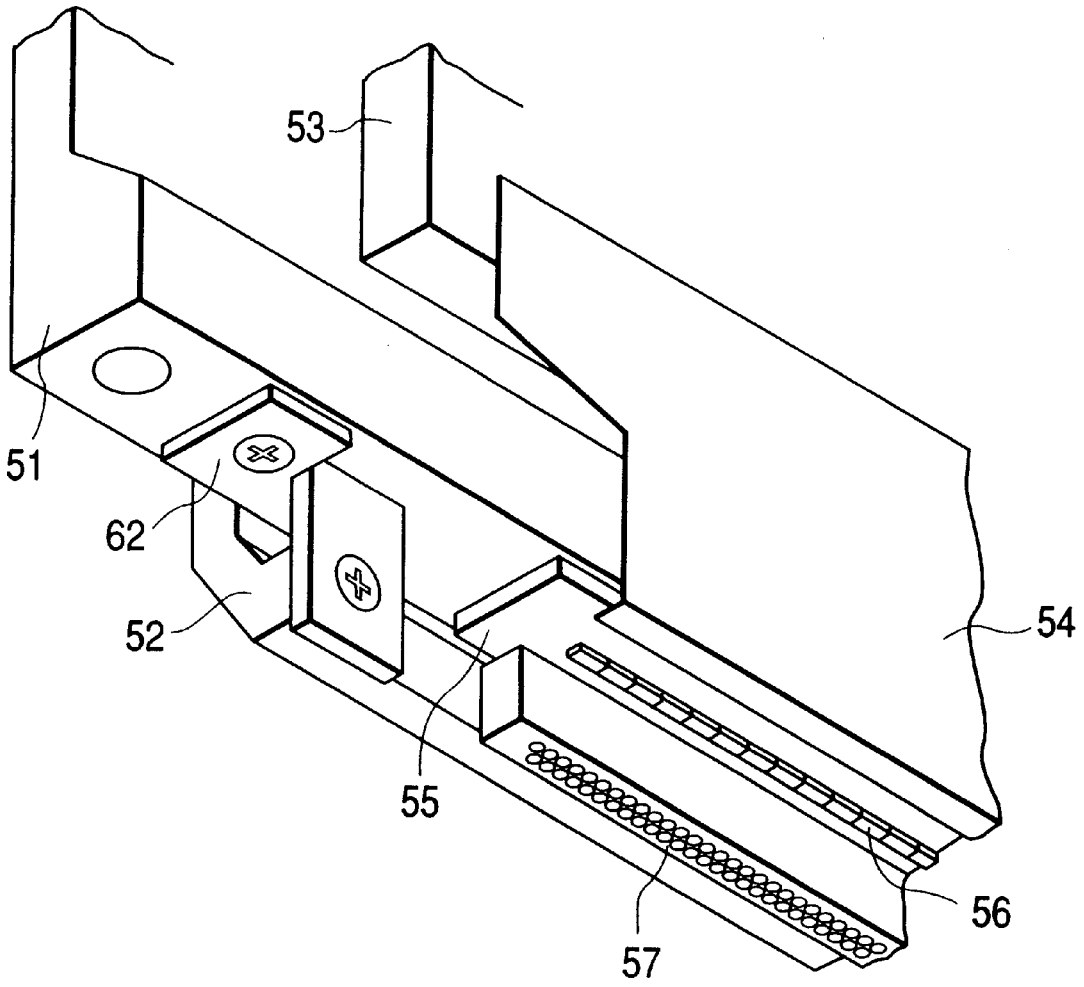
FIG. 3 is a partially enlarged perspective view of the exposure apparatus according to the present invention.

FIGS. 2 and 3 show the exposure LED head (exposure apparatus) 15 in detail. FIG. 2 is a sectional view of the exposure LED head 15, and FIG. 3 is a partial enlarged perspective view of the same. In the following description, the photosensitive drums 13C, 13M, 13Y, and 13K will be merely referred to as photosensitive drums 13.

A plurality of light-emitting elements are constructed into an array on the surface of a light-emitting chip 56 by the semiconductor device manufacturing process. A plurality of light-emitting chips 56 each formed in this manner are placed on a board (having a wiring pattern), on which the light-emitting chips are to be mounted, to form a light source array (linear array). The direction of the linear array coincides with the axis of the photosensitive drum 13. The light-emitting chip mounted board 55 is made of a ceramic material that dissipates heat generated by the light-emitting chips 56 well, and is fixed to a board base 51 also having a heat dissipating function with a means such as an adhesive, screws, or a double-coated tape.

Driver chips (not shown) for driving the respective light-emitting elements described above, and resistors (not shown) are mounted on a driver board (having a wiring pattern) 53. A signal for controlling the emission pattern is also input to the driver board 53. The driver board 53 is fixed to the board base 51, on which the light-emitting chip mounted board 55 is fixed, with screws. The light-emitting chip mounted board 55 and driver board 53 are electrically connected to each other through a flexible cable 54. When the light-emitting chip mounted board 55, on which the light-emitting chips 56 are mounted, and the driver board 53 are separated in this manner, heat generated by the drivers and resistors mounted on the driver board 53 is not transmitted to the light-emitting chips 56 easily, and the exposure LED head can be downsized. The board base 51 is made of aluminum, to which heat from the light-emitting chip mounted board 55 and driver board 53 is transmitted easily and which has a good workability.

Light emitted by the light-emitting chips 56 form microspots on the surface of the photosensitive drum 13 serving as the recording medium in the color image forming apparatus through the focusing optical fiber lens array 57, to form a latent image on the photosensitive drum 13. The focusing optical fiber lens array 57 is adhered to a lens support 52. To form clear microspots on the surface of the photosensitive drum 13, the light-emitting chips 56, photosensitive drum 13, and focusing optical fiber lens array 57 must be fixed to establish a predetermined positional relationship. For this purpose, the lens support 52 adhered with the focusing optical fiber lens array 57 is adjusted and fixed at a predetermined position with respect to the light-emitting chips 56.

FIG. 3 shows a portion where the lens support 52 is fixed. The lens support 52 is adjusted with respect to a member 62 in the direction of the lens optical axis (vertical direction in FIG. 2), and is fixed to the member 62 with screws. The member 62 is adjusted with respect to the board base 51 in the sheet convey direction (direction perpendicular to the lens optical axis and the array of the light-emitting chips), and is fixed to the board base 51 with screws. More specifically, when the board base 51 and lens support 52 are fixed to each other through the member 62, the focusing optical fiber lens array 57 can be adjusted and fixed to a position parallel to the light-emitting chip array and remote from it by a predetermined distance in a predetermined posture. Although FIG. 3 shows only one end of the exposure LED head, the focusing optical fiber lens array 57 is supported and fixed at the other end in the same manner. The lens support 52 is made of aluminum which is inexpensive and can provide rigidity easily.

FIG. 2 also shows a cover 58 and seals 59 and 60. The seals 59 and 60 prevent the chips from dust and the like and are made of a resilient material such as urethane foam. The cover 58 and seals 59 and 60 are not illustrated in FIG. 3.

A heat conductive member 61 made of a heat conductive material such as silicone grease or silicone rubber fills a gap between the board base 51 and lens support 52. The heat conductive member 61 extends throughout the entire length (the entire length of the light-emitting chip array) of the lens support 52.

Hence, heat is exchanged between the board base 51 and lens support 52 to always set them at almost the same temperature. Since the board base 51 and lens support 52 are made of the same material, i.e., aluminum, if they are set at the same temperature, they have the same amount of thermal expansion, and are not distorted accordingly. As a result, the linearity of the array of the light-emitting chips 56 and focusing optical fiber lens array 57, and the parallel degree between the light-emitting chips 56 and focusing optical fiber lens array 57 can be maintained.

More specifically, when the exposure LED head 15 emits light in the recording apparatus, the light-emitting chips 56 and the driver chips produce heat. This heat is transmitted to the board base 51 to heat it. The board base 51 made of aluminum expands thermally as its temperature increases. If the heat conductive member 61 is not used, the lens support 52 is not in contact with a heat source, so its temperature does not change to cause thermal expansion. Since the thermally expanded board base 51 and the thermally non-expanded lens support 52 are connected to each other at two ends through the member 62, they produce a stress. Both the board base 51 and lens support 52 are distorted accordingly to bend the light-emitting chip array that should be straight. This inconvenience can be solved by interposing the heat conductive member 61 between the board base 51 and lens support 52 as described above.

As the heat conductive member 61, a metal piece or the like may be used. However, a resilient body such as silicone grease or silicone rubber described above is preferable. Then, even if the gap between the board base 51 and lens support 52 is changed to adjust the position of the focusing optical fiber lens array 57, this gap can be filled, and a force will not act on the focusing optical fiber lens array 57 and lens support 52 as much as possible.

When the gap between the board base 51 and lens support 52 is filled with the heat conductive member 61 in the above manner, a foreign substance such as toner or dust is prevented from entering through this gap.

Figure 4:
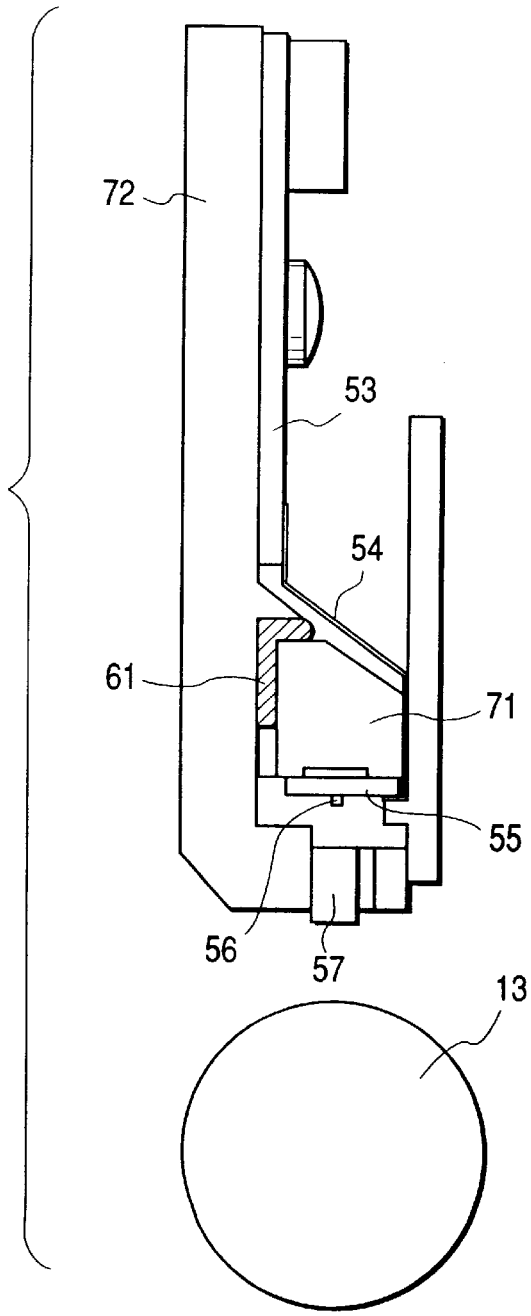
FIG. 4 is a sectional view of another exposure apparatus according to the present invention.

An exposure apparatus according to another embodiment of the present invention will be described with reference to FIG. 4. FIG. 4 is a sectional view of the exposure LED head of this embodiment. In FIG. 4, members having the same functions as in FIG. 2 are denoted by the same reference numerals.

The exposure LED head shown in FIG. 4 is identical to that shown in FIG. 2 described above in terms of function. However, a driver board 53 is not fixed to a board base 71 that supports a light-emitting chip mounted board 55, but to a lens support 72 that supports a focusing optical fiber lens array 57. In this case as well, the gap between the board base 71 and lens support 72 is filled with a heat conductive member 61 made of a resilient body to eliminate a temperature difference between them.

In this embodiment as well, the same function and effect as in the embodiment shown in FIGS. 1 to 3 can be obtained.

The state as shown in FIG. 2 or the state as shown in FIG. 3 can be selected as required in accordance with the spatial margin of the exposure LED head mounting portion in the recording apparatus.

The description of the above embodiments is made concerning a color image forming apparatus which obtains a color image by overlaying images of four colors. However, it is obvious that the present invention can be similarly applied to an exposure apparatus for a single-color image forming apparatus.

As has been described above, according to the present invention, in an exposure head, since a heat conductive member fills the gap between a member for supporting a component that generates heat and a member for supporting a component that does not generate heat, a temperature difference between the two members can be decreased. As a result, even if heat is generated by the operation of the apparatus, no distortion occurs in the exposure apparatus, and appropriate exposure can always be performed.

According to the present invention, a foreign substance can be prevented from attaching to the light-emitting portion and image forming means, so an exposure defect does not occur.

What is claimed is:

1. An exposure apparatus comprising:

light-emitting means having a linear array of a plurality of light-emitting elements;

a driver for driving said light-emitting elements;

a lens for focusing light emitted by said light-emitting elements on a predetermined position;

a first support for supporting said light-emitting means and said driver;

a second support for supporting said lens; and a heat conductive member interposed in a gap between said first and second supports.

2. An apparatus according to claim 1, wherein said first and second supports are made of the same material.

3. An apparatus according to claim 1, wherein said heat conductive member is a resilient member.

4. An apparatus according to claim 1, wherein said lens is a focusing optical fiber lens array.

5. An exposure apparatus comprising;

light-emitting means having a linear array of a plurality of light-emitting elements;

a driver for driving said light-emitting elements;

a lens for focusing light emitted by said light-emitting elements on a predetermined position;

a first support for supporting said light-emitting means;

a second support for supporting said driver and said lens; and a heat conductive member interposed in a gap between said first and second supports.

6. An apparatus according to claim 5, wherein said first and second supports are made of the same material.

7. An apparatus according to claim 5, wherein said heat conductive member is a resilient member.

8. An apparatus according to claim 5, wherein said lens is a focusing optical fiber lens array.

9. An image forming apparatus comprising:

light-emitting means having a linear array of a plurality of light-emitting elements;

a driver for driving said light-emitting elements;

a photosensitive member;

a lens for focusing light emitted by said light-emitting elements on said photosensitive member;

a first support for supporting said light-emitting means and said driver;

a second support for supporting said lens; and a heat conductive member interposed in a gap between said first and second supports.

10. An apparatus according to claim 9, wherein said first and second supports are made of the same material.

11. An apparatus according to claim 9, wherein said heat conductive member is a resilient member.

12. An apparatus according to claim 9, wherein said lens is a focusing optical fiber lens array.

13. An image forming apparatus comprising:

light-emitting means having a linear aray of a plurality of light-emitting elements;

a driver for driving said light-emitting element;

a photosensitive member;

a lens for focusing light emitted by said light-emitting elements on said photosensitive member a first support for supporting said light-emitting means;

a second support for supporting said driver and said lens; and a heat conductive member interposed in a gap between said first and second supports.

14. An apparatus according to claim 13, wherein said first and second supports are made of the same material.

15. An apparatus according to claim 13, wherein said heat conductive member is a resilient member.

16. An apparatus according to claim 13, wherein said image forming means lens is a focusing optical fiber lens array.

17. An apparatus according to any one of claims 1, 5, 9, and 13, wherein said light-emitting means includes a chip on which said light-emitting elements are formed and a board on which said chip is mounted, and said board is supported by said first support.

18. An apparatus according to claim 17, wherein said board is made of a ceramic material.

19. An apparatus according to any one of claims 1, 5, 9, and 13, wherein said first and second supports are made of aluminum.

20. An apparatus according to any one of claims 1, 5, 9, and 13, wherein said heat conductive member is made of a silicone grease or a silicone rubber.

* * * * *